US005125450A

United States Patent [19]

Kidd et al.

[11] Patent Number: 5,125,450

[45] Date of Patent: * Jun. 30, 1992

[54] METHOD OF AND SYSTEM FOR CONTROLLING FLOW OF MOLTEN LIQUID TO CAST METAL ALLOYS

[75] Inventors: Thomas F. Kidd, Toledo, Ohio; Stephen A. Thompson, St. Bruno, Canada

[73] Assignee: Electrovert Ltd., Quebec, Canada

[ * ] Notice: The portion of the term of this patent subsequent to Feb. 12, 2008 has been disclaimed.

[21] Appl. No.: 629,666

[22] Filed: Dec. 19, 1990

Related U.S. Application Data

[63] Continuation-in-part of Ser. No. 520,213, May 7, 1990, Pat. No. 4,991,641.

[51] Int. Cl.[5] ..... B22D 17/04; B22D 17/32

[52] U.S. Cl. ..... 164/457; 164/113; 164/133; 164/154; 164/155; 164/316; 164/318

[58] Field of Search ..... 164/457, 154, 155, 113, 164/120, 133, 316, 318

[56] References Cited

U.S. PATENT DOCUMENTS

| | | | |
|---|---|---|---|
| 3,767,339 | 10/1973 | Hunkar | 164/154 X |
| 3,956,973 | 5/1976 | Pomplas | 164/154 X |
| 4,252,176 | 2/1981 | Page | 164/155 |
| 4,488,589 | 12/1984 | Moore et al. | 164/457 X |
| 5,022,457 | 6/1991 | Iwamoto et al. | 164/457 X |

FOREIGN PATENT DOCUMENTS

| | | | |
|---|---|---|---|
| 0126174 | 11/1984 | European Pat. Off. | 164/457 |
| 3142811 | 5/1983 | Fed. Rep. of Germany | 164/457 |
| 3636936 | 5/1988 | Fed. Rep. of Germany | 164/154 |

*Primary Examiner*—J. Reed Batten, Jr.
*Attorney, Agent, or Firm*—Darby & Darby

[57] ABSTRACT

In the casting of metal alloys with low melting temperatures, an improved control system for lowering an injection piston in an injection cylinder is provided to avoid porosity occurring in castings. There is a fluid operated drive cylinder with a drive piston connected to the injection piston. A transducer is linked to the injection piston to provide an indication of location, and a controller compares the position of the injection piston with a predetermined time/distance profile and produces an injection stroke signal which is used to control the drive cylinder and ensure the injection piston follows the time/distance profile.

11 Claims, 2 Drawing Sheets

METHOD OF AND SYSTEM FOR CONTROLLING FLOW OF MOLTEN LIQUID TO CAST METAL ALLOYS

This application is a continuation-in-part of U.S. patent application Ser. No. 520,213 filed May 7, 1990 and now U.S. Pat. No. 4,991,641.

TECHNICAL FIELD OF THE INVENTION

The present invention relates to a metal casting process to produce meltable metal cores for subsequent molding of components made of plastic materials and encapsulating components such as turbine blades so they may be held for machining and other finishing steps. More specifically, the present invention relates to a system for controlling the flow of molten liquid in an apparatus for producing a casting or encapsulation.

BACKGROUND OF THE INVENTION

Melt out metal cores of complex shapes are made for use as cores in subsequently molded plastic components. The cores are made of metal alloy or other suitable material having a low melting temperature. They are placed in molds for making undercut hollow plastic components and then subsequently removed from the plastic components by melting the cores and leaving the undercut or hollow plastic components. The melting temperature of the metal alloy or other material is lower than that of the plastic component. In other embodiments metal alloys with low melting temperatures are used for encapsulating components such as turbine blades so they may be held for machining in other finishing steps. After use the metal from the cores or encapsulations is remelted and reused. One example of an apparatus for casting metal alloys with low melting temperatures is disclosed in U.S. Pat. No. 4,676,296. In this patent, molten metal alloy is injected by a piston moving downwards in a cylinder placed within a tank of molten metal alloy. The liquid metal alloy passes through a passageway from the bottom of the cylinder into a mold or die.

The casting of metal alloys with low melting temperatures is not similar to die casting. Die casting occurs at high pressures and dies are filled in a very short period of time. In the case of producing metal cores or encapsulations, it is necessary to allow the liquid metal alloy to flow substantially under no pressure into the mold or die. If pressure is used then porosity can occur in the casting which is unacceptable. The time to fill a mold or die is far longer than for die casting. Thus, it is apparent that controlling the flow of metal alloy into a mold or die is critical.

In our co-pending application Ser. No. 268,492 filed Nov. 8, 1988, and now U.S. Pat. No. 4,958,675, a metal casting process is disclosed wherein the injection cylinder is filled with molten metal alloy from the tank through a valve port in the injection passageway leading to the injection cylinder by raising the piston in the cylinder. The system discloses a block valve outside the tank in the passageway to the die.

SUMMARY OF THE INVENTION

We have now found that an improvement can be made by controlling the flow of molten metal from the injection cylinder to the die. The speed of the injection piston moving down the injection cylinder controls the flow of molten metal. This flow can be a substantially constant flow or may be a variable flow dependent upon the movement of the piston in the cylinder. By controlling the injection flow, one is able to achieve a good quality casting or encapsulation. If injection speeds are too fast, the casting can have porosity, and if the speeds are too slow, then the molten metal can start to solidify before the injection stroke is complete.

The present invention provides in an apparatus for producing a casting or encapsulation from a molten liquid wherein an injection cylinder has an injection piston to reciprocate therein, the injection piston adapted to move in one direction providing an injection stroke to inject molten liquid into a die, and to move in the other direction providing a fill stroke to fill the injection cylinder with molten liquid, the improvement of means for controlling the speed of the injection piston in the injection stroke comprising displacement transducer means to provide a displacement signal representative of position of the injection piston in the injection cylinder, comparison means to compare the displacement signal with a predetermined time/distance profile for the injection stroke and provide an injection stroke signal, and means to move the injection piston in the injection cylinder in accordance with the injection stroke signal.

The present invention also provides in a method for producing a casting or encapsulation from a molten liquid, wherein an injection cylinder has an injection piston to reciprocate therein, the injection piston moving in the injection cylinder to provide an injection stroke to inject molten metal into a die, the improvement of controlling the speed of the injection piston for the injection stroke comprising the steps of: determining relative position of the injection piston in the injection stroke, comparing the relative position of the injection piston with a predetermined time/distance profile for the injection stroke to produce an injection stroke signal, and moving the injection piston in the injection cylinder in accordance with the injection stroke signal.

BRIEF DESCRIPTION OF THE DRAWINGS

In drawings which illustrate embodiments of the invention.

DETAILED DESCRIPTION OF THE PREFERRED EMBODIMENTS

Figure 1:
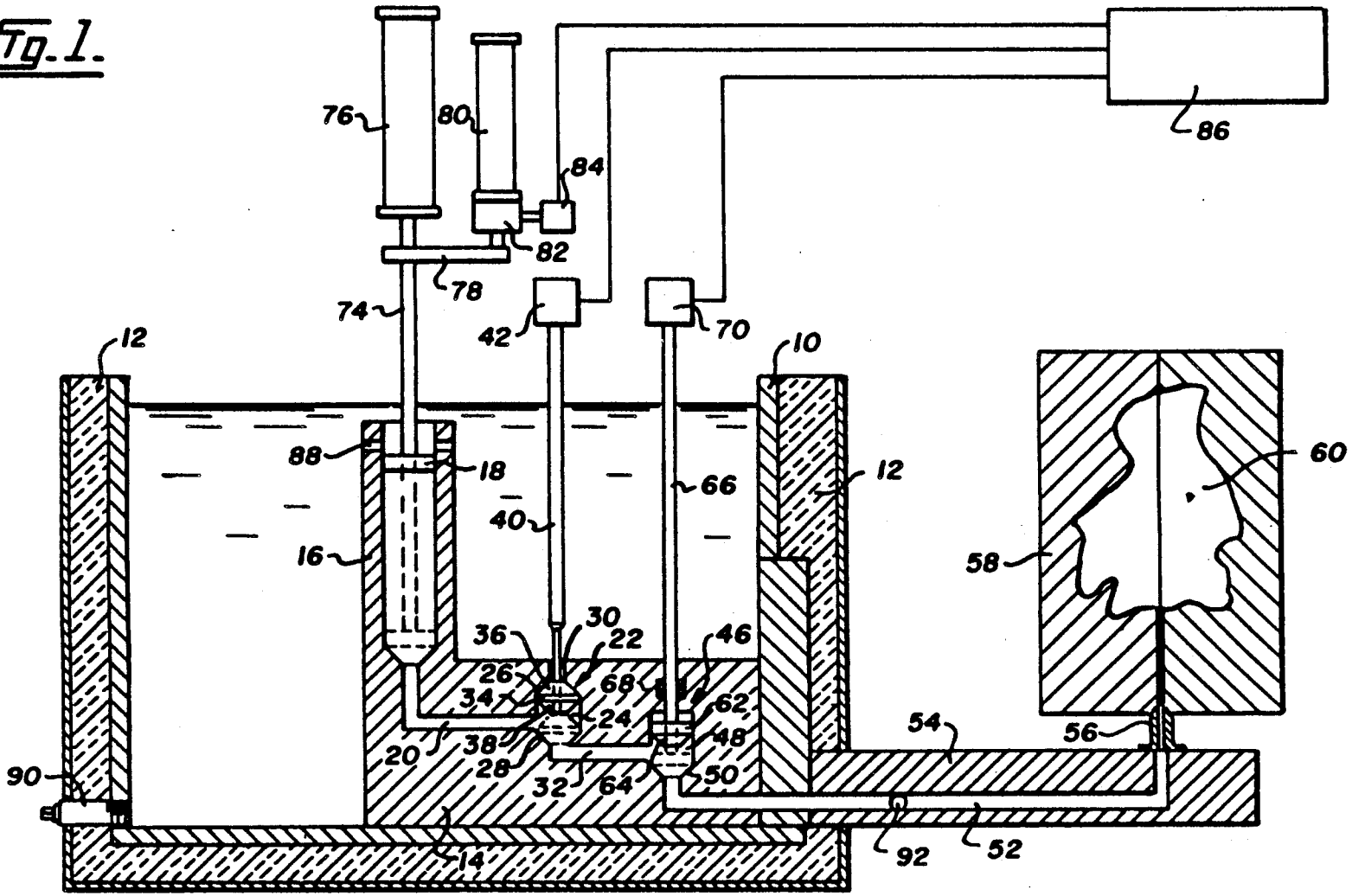
FIG. 1 is sectional view through a tank showing a cylinder, valve arrangement and passageway to a die.

Referring now to FIG. 1, a liquid tank 10 with insulation 12 surrounding the tank, and a molten liquid material such as metal alloy, is kept hot in the tank so it is always in the molten state. Heaters for the tank are not shown herein but are generally of the external type that are located on the sides and bottom of the tank.

A cylinder and valve block assembly 14 is shown within the tank sitting on the bottom. The valve block assembly 14 is detachable from the tank 10 so it can be removed to facilitate servicing. The valve block assembly 14 is located in the corner of the tank 10 so no metal alloy is present between the tank wall and the valve body 14. This avoids distortion and change which can otherwise occur due to thermal expansion during meltdown. Within the assembly is an injection cylinder 16 having an injection piston 18 therein and below the injection cylinder 16 is a first passageway 20 which extends to a first valve 22. The first valve 22 has a valve chamber 24 with a tapered top shoulder 26 and a tapered bottom shoulder base 28. Above the tapered top shoulder 26 and in the center there is a valve port opening 30 which opens to the tank 10. The valve port opening 30 is located at an elevation below the bottom of the cylinder 16. Below the tapered bottom shoulder 28, and in the center thereof, is an opening to a second passageway 32. The first valve 22 has a cylindrical member 34 which reciprocates within the chamber 24 and has a tapered top valve seat 36 and a tapered bottom valve seat 38. When the first valve 22 is in the first position (open), the top valve seat 36 seals with the tapered top shoulder 26 in the valve chamber 24. The first passageway 20 is then open to convey molten liquid to the second passageway 32. When the valve 22 is in the second position (closed), the bottom valve seat 38 seals with the tapered bottom shoulder 28 in the valve chamber 24. When in this position, the valve port opening 30 from the tank 10 is open to the injection cylinder 16 and the second passageway 32 is closed.

The cylindrical member 34 is attached to a first valve stem 40 which in turn connects to an operator 42. The operator is shown as a solenoid however, pneumatic or hydraulic operators may also be provided.

The second passageway 32 extends to a second valve 46 which has a second valve chamber 48 with a tapered bottom shoulder 50 having at its center an exit to a passageway 52 leading through the wall of the tank 10 into an exterior block 54 and up through a nozzle 56 into a die 58. The die 58 or mold is preferably formed in two halves and is removable from the nozzle 56 for separation thus allowing the casting 60 to be removed from the die 58.

The second valve 46 has a cylindrical member 62 with a tapered bottom seat 64 to seal the valve on the tapered bottom shoulder 50 within the valve chamber 48. The cylindrical member 62 is attached to a second valve stem 66 which passes through seal 68 in the top of the block assembly 14 and then extends up above the level of molten liquid in the tank to an operator 70 preferably a solenoid or other suitable actuator such as a pneumatic or hydraulic operator, which permits the second valve 46 to be closed by lowering the second valve stem 66 so that the valve seat 64 on the cylindrical member 62 seals into the tapered bottom shoulder 50 within the valve chamber 48, thus closing the second valve 46. The second valve 46 is opened by raising the second valve stem 66 so the cylindrical member 62 allows molten liquid from the passageway 32 to pass to the final passageway 52 leading to the die 58.

The injection piston 18 is supported by a shaft 74 which moves up and down powered by a drive cylinder 76. In one embodiment this is a pneumatic cylinder, in another embodiment a hydraulic cylinder may be supplied. Drive cylinder 76 is double acting and has adjacent to it and joined by a bridge 78 to a hydraulic cylinder 80 with a hydraulic valve 82 having a stepper motor 84 to open and close the hydraulic valve 82 and thus affect speed control of the injection piston 18. This provides a variable speed injection stroke. The drive cylinder 76 powers a drive piston (not shown) connected by piston shaft 74 to the injection piston 18 and the speed of the injection piston is set by the stepper motor 84. A microprocessor 86 operates the stepper motor 84 thus controlling the speed of the injection piston 18 in the injection cylinder 16. The microprocessor also operates the solenoid operator 42 for the first valve 22 and the solenoid operator 70 for the second valve 46 to ensure the correct sequence of steps occurs in the casting process.

Figure 2:
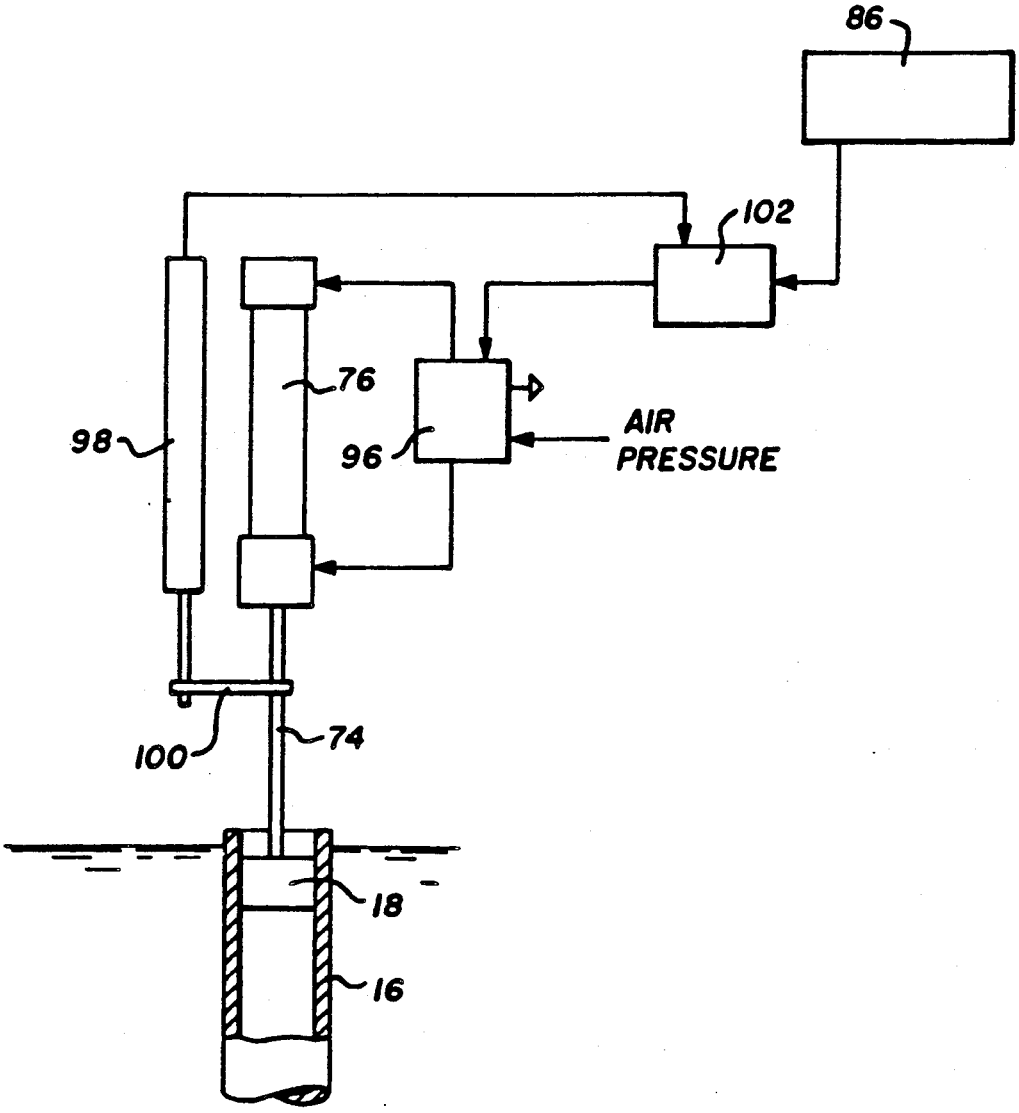
FIG. 2 is a schematic view of another speed control arrangement for the injection piston.

In a preferred embodiment the control of the injection piston 18 in the injection cylinder 16 occurs by a system disclosed in FIG. 2. The control of the injection piston 18 may be used for producing a casting or an encapsulation from a molten liquid. The system is not restricted to that shown in FIG. 1 wherein the first valve 22 and the second valve 46 is contained within the tank 10 but may be used in any injection process requiring a controlled flow of molten liquid. In this system, the injection piston 18 is attached to a piston shaft 74 which in turn is connected to a drive piston (not shown) within a drive cylinder 76. The drive cylinder may be a pneumatic cylinder or a hydraulic cylinder to supply compressed air or hydraulic fluid. A servo valve 96 provides precise monitoring of compressed air or hydraulic fluid to the top or bottom of the drive cylinder 76. This precise control by the servo valve 96 prevents pressure build up in the injection cylinder 16. The servo valve 96 as shown in FIG. 2 is pneumatically operated. Compressed air is supplied as the operating fluid. In another embodiment the servo valve 96 is hydraulically operated.

A linear displacement transducer 98 has a link or bridge 100 joined to the shaft 74 of the injection piston 18 to provide an accurate indication of position of the injection piston 18 within the injection cylinder 16. In one embodiment the transducer 98 may be incorporated within the cylinder 76, thus the position of the drive piston within the cylinder 76 is continuously monitored. A signal from the transducer 98 is fed to a servo valve controller 102. Utilizing low pressure, the movement of the drive piston in the drive cylinder 76 is controlled by the servo valve 96. The microprocessor 86 has programmed therein a predetermined time/distance profile for the injection stroke of the injection piston 18 moving down in the injection cylinder 16. This profile is determined based upon the casting 60 to be formed in the mold or die 58. A large casting would require a longer stroke. A casting having a complicated profile would likely have a different time/distance profile to a simple casting.

In another embodiment it is preferred that the stroke commence slowly, speed up during the main injection period and then slow down towards the end of the stroke. The profile is determined for the particular requirement of casting and programmed into the microprocessor.

The predetermined time/distance profile for the injection stroke produces a signal from the microprocessor 86 to the servo valve controller 102 where it is compared with the position of the injection piston 18 by means of the transducer 98. A further signal is provided from the controller 102 to the servo valve 96 which in turn determines the flow of fluid, either air or hydraulic fluid, to the top of the drive cylinder 76 thus moving the drive piston downwards at a predetermined speed to ensure pressure does not build up in the injection cylinder 16. Once the injection stroke is complete, the microprocessor 86 controls the time that the injection piston 18 remains at the bottom of the injection cylinder 16 and then feeds another signal through the controller 102 so that air or hydraulic fluid is provided through the servo valve 96 to the bottom of the drive cylinder 76 to raise the injection piston 18 in the injection cylinder 16.

In the process of casting, the injection piston 18 is raised to the top of its stroke, which is shown in FIG. 1 as positioned below drainage holes 88 whose use will be described hereafter. The first valve 22 referred to as the safety valve is at the time of filling in the second position sealing the second passageway 32 but allowing the molten liquid to enter the injection cylinder 16 through the valve port opening 30. The second valve 46 referred to as the dispense valve, is closed, that is to say the cylindrical member 62 is in the bottom position thus closing the passageway 52.

To begin the cycle, the first valve 22 or safety valve moves from the second position to the first position with the first valve stem 40 moving upwards, so that the valve port opening 30 is closed and the second passageway 32 is open. Immediately after, the second valve 46 moves to the top position, completing the opening from the cylinder 16 to the nozzle 56. After a short delay, approximately half a second, the injection piston 18 is moved downwards in the injection cylinder 16 so that the molten liquid flows through the passageways 20, 32 and 52 into the die 58. The movement downward is controlled so that substantially no pressure builds up in the molten liquid while the die 58 is being filled. The time to fill the die 58 varies from approximately 3 to 30 seconds depending upon the die volume. After the mold is full, a small pressure is built up in the molten liquid by the injection piston 18 being forced down in the injection cylinder 16. The pressures are generally in the range of about 30 to 50 pounds per square inch. Higher pressures are possible but higher pressures can in some circumstances result in porous castings due to the resultant high speed flow of metal entering the die 58. When the die is full and the small pressure has built up, it is generally maintained under pressure for a time in the order of about 1 to 10 seconds, dependent upon the size of the metal part.

After the die is full, the second valve 46 or dispense valve, closes by moving downwards so that the cylindrical member 62 seals against the tapered bottom shoulder 50. After this has occurred, the first valve 22 or safety valve, moves from the first position to the second position thus closing the second passageway 32 and opening the valve port opening 30. After this has been completed the injection piston 18 moves slowly upwards filling the injection cylinder 16 by molten liquid entering the valve port opening 30 and the first passageway 20. When the injection piston 18 reaches its top position as shown in FIG. 1, the system is ready to commence its next cycle.

The flow rate of molten liquid into the die 58 varies in the range of about 0.01 to 1 kilogram per second depending on the size of the core or article to be molded. The injection time and the time delays between the sequence operation of the valve is all controlled by the microprocessor 86. This microprocessor 86 can be programmed for different articles being cast dependent upon their size and complexity of shape. The program is so arranged that the speed of injection and the sequence of opening valves is designed for a specific article being cast.

The tank 10 has a drain 90 with a plug or valve therein. Furthermore, a further drain 92 with a plug therein is provided at the lowest position of the passageway 52 outside the tank 10. If it is necessary to drain the system, then first of all the injection piston 18 is raised above the drainage holes 88, the first valve 22 is positioned in the first (open) position and the second valve 46 is opened. At the same time the drain 90 from the tank 10 is opened and the drain 92 from the passageway 52 is opened. Molten liquid drains out of the tank through the two drains. Because the injection piston 18 is raised above the drainage holes, air is permitted to enter the injection cylinder 16 allowing the molten liquid to drain away through the passageway 32 and 52 and out of the drain 92 in the passageway 52. By this method all of the liquid in the tank and valve system is drained.

Various changes may be made to the embodiments shown herein without departing from the scope of the present invention which is limited only by the following claims.

The embodiments of the present invention in which an exclusive property or privilege is claimed are defined as follows:

1. An apparatus for producing a casting from a molten metal comprising:

a tank adapted to contain the molten metal; an injection cylinder located in the tank having a connection to an injection passageway leading through the tank to a die located outside the tank;

an injection piston within the cylinder;

a valve in the injection passageway, having a first position wherein the injection passageway from the cylinder to the die is open, and a second position wherein the injection passageway to the die is closed and a valve port opening is open from the cylinder to the tank;

valve operating means to transfer the valve between the first and second positions;

displacement transducer means to provide a displacement signal representative of position of the injection piston in the injection cylinder;

comparison means to compare the displacement signal with a predetermined time/distance profile for an injection stroke to provide an injection stroke signal representing substantially no pressure in the die during injection of the molten metal therein; and means to move the injection piston in the injection cylinder in accordance with the injection stroke signal.

2. The apparatus for producing a casting according to claim 1 including a double acting fluid operated drive cylinder with a drive piston therein, the drive piston therein connected by a shaft to the injection piston.

3. The apparatus for producing a casting according to claim 2 wherein the drive cylinder is operated hydraulically.

4. The apparatus for producing a casting according to claim 2 wherein the drive cylinder is operated pneumatically.

5. The apparatus for producing a casting according to claim 1 including a mechanical link between the displacement transducer means and the injection piston.

6. The apparatus for producing a casting according to claim 2 including a servo valve to control a fluid to the double acting drive cylinder.

7. The apparatus for producing a casting according to claim 6 comprising a servo valve controller to control operation of the servo valve, the servo valve controller receiving a signal from the displacement transducer means and from a microprocessor containing the predetermined time/distance profile program therein.

8. The apparatus for producing a casting according to claim 6 wherein the servo valve is pneumatically operated and the drive cylinder is pneumatically operated.

9. The apparatus for producing a casting according to claim 6 wherein the servo valve is pneumatically operated and the drive cylinder is hydraulically operated.

10. The apparatus for producing a casting according to claim 6 wherein the servo valve is hydraulically operated and the drive cylinder is hydraulically operated.

11. A method of producing a casting from a molten metal utilizing an injection cylinder having an injection piston therein, the cylinder being located in a tank containing molten metal, and means to raise and lower the injection piston in the injection cylinder, an injection passageway leading from the injection cylinder to a die external of the tank, the injection passageway having a valve therein, the valve having a valve port opening to the tank, the method comprising the steps of:

operating the valve to open the injection passageway from the injection cylinder to the die and close the valve port opening to the tank;

determining relative position of the injection piston in the injection cylinder;

comparing the relative position of the injection piston with a predetermined time/distance profile for an injection stroke to produce an injection stroke signal representing substantially no pressure in the die during injection of the molten metal therein;

lowering the injection piston in the injection cylinder in accordance with the injection stroke signal;

after a predetermined time delay, operating the valve to close the injection passageway from the cylinder to the die and open the valve port opening to the tank; and raising the injection piston in the injection cylinder to fill the cylinder with molten metal from the tank through the valve port opening.

* * * * *